US007377217B2

(12) United States Patent
Swanson

(10) Patent No.: US 7,377,217 B2
(45) Date of Patent: May 27, 2008

(54) DECOY DEVICE AND SYSTEM FOR ANTI-MISSILE PROTECTION AND ASSOCIATED METHOD

(75) Inventor: Jon D. Swanson, Saugus, CA (US)

(73) Assignee: The Boeing Company, Chicago, IL (US)

( * ) Notice: Subject to any disclaimer, the term of this patent is extended or adjusted under 35 U.S.C. 154(b) by 401 days.

(21) Appl. No.: 10/967,508

(22) Filed: Oct. 18, 2004

(65) Prior Publication Data

US 2006/0096493 A1 May 11, 2006

(51) Int. Cl.
*F42B 12/46* (2006.01)
*F42B 15/00* (2006.01)
*F42B 4/06* (2006.01)

(52) U.S. Cl. ..... 102/347; 102/375; 102/370; 89/1.51

(58) Field of Classification Search ..... 89/1.51, 89/1.8, 1.11, 1.1; 102/336, 345, 347, 356, 102/361, 364, 374, 375, 376, 381, 501, 505, 102/367, 370
See application file for complete search history.

(56) References Cited

U.S. PATENT DOCUMENTS 3,779,009 A 12/1973 Friedman
4,069,664 A 1/1978 Ellion et al.
4,804,520 A 2/1989 Richtenburg et al.
5,251,436 A * 10/1993 Brogan ..... 60/254
5,561,260 A * 10/1996 Towning et al. ..... 102/336
5,585,594 A * 12/1996 Pelham et al. ..... 102/336
5,763,818 A 6/1998 Guymon et al.
5,834,680 A 11/1998 Nielson et al.
6,352,031 B1 3/2002 Barbaccia
6,427,599 B1 * 8/2002 Posson et al. ..... 102/336
7,059,250 B1 * 6/2006 Sutherland et al. ..... 102/205
2003/0047104 A1 3/2003 Raz
2003/0142005 A1 7/2003 Bar-Avi et al.
2003/0205126 A1 11/2003 O'Neill
2004/0011235 A1 1/2004 Callaway et al.

* cited by examiner

*Primary Examiner*—James S Bergin
(74) *Attorney, Agent, or Firm*—Alston & Bird LLP

(57) ABSTRACT

A decoy device and system for anti-missile protection and an associated method are provided. The decoy device includes a propellant and a tank containing the propellant. The decoy device also includes an outlet defined in the tank, and a catalyst contained within the tank and capable of exothermically reacting with the propellant to emit a gas having a heat and pressure. The heat generated by the reaction is radiated by the decoy device is capable of attracting a missile, while the gas is expelled through the outlet to provide thrust to the decoy device.

36 Claims, 5 Drawing Sheets

DECOY DEVICE AND SYSTEM FOR ANTI-MISSILE PROTECTION AND ASSOCIATED METHOD

BACKGROUND OF THE INVENTION

1) Field of the Invention

The present invention relates to anti-missile protection, more particularly, to a deployable decoy device for protecting a target vehicle from surface-to-air, air-to-air, or similar missiles.

2) Description of Related Art

Aircraft may be susceptible to attacks from surface-to-air and air-to-air missiles. These missiles are generally "heat seeking" and employ infrared guidance such that they do not emit signals that may be detected by the target. The infrared-guided missiles typically seek in a specified wavelength and, as such, may detect sources of non-natural radiated energy, such as the emissions of an aircraft engine.

A number of techniques have been developed to protect aircraft from surface-to-air and air-to-air missiles. Flares are the most common devices used as a decoy, although other techniques, such as suppressants, shields and blocking devices, pyrophorics, and directional infrared counter measures, may be used. Flares typically comprise pyrotechnic compositions bound together with an organic binder and pressed to form pellets. One or more pellets are deployed from the flare and ignited following missile launch such that each pellet burns over its surface to produce an infrared source, and in a manner that simulates the engines of the target aircraft such that the missile is lured to the burning pellet and away from the target aircraft. Successive pellets are deployed and ignited to continuously attract and lure the missile away from the aircraft, as each pellet will eventually burn out.

However, several flares and pellets must be used since the pellets are incapable of maintaining flight once deployed. As a result, the aircraft must be equipped with several flares that may be used for a single missile since the pellets eventually burn out, which may ultimately sacrifice flight efficiency by increasing weight and the amount of space required on the aircraft for the flares. Moreover, most sophisticated missiles are capable of determining the difference in movement between the trajectory of the aircraft and a pellet that simply falls from an aircraft, such that the missile continues to track the aircraft even as pellets are launched.

As a result of the aforementioned drawbacks, kinematic flares have been developed, which are designed to fly along with the aircraft to extend the exposure time of the flare, rather than having the flare fall as soon as deployed from the target aircraft. An example of a kinematic flare is disclosed in U.S. Pat. No. 5,834,680 to Nielson et al. The Nielson patent discloses a black body decoy flare for thrusted applications. The decoy flare includes a metal fuel (e.g., magnesium, aluminum, or mixtures thereof), ammonium perchlorate as a main oxidizer, a binder (e.g., hydroxyl-terminated polybutadiene), and high carbon content compounds (e.g., aromatic or polyaromatic compounds). The ammonium chlorate combusts with the metal fuel to produce high temperature gaseous reaction products, where the gaseous reaction products are useful for producing thrust in the decoy flare. The high carbon content compounds are added to improve the efficiency of the black body radiator, as well as help contain the high temperatures with the decoy housing, such that the high temperatures do not destroy the decoy flare. Even with respect to kinematic flares, the flares typically employ a fuel that burns out of control once ignited, which increases the potential for ground fires. In addition, the burning fuel tends to produce toxic byproducts.

It would therefore be advantageous to provide a decoy device that is capable of reacting quickly and luring a missile away from a target vehicle during an attack. It would also be advantageous to provide a decoy device that may defend a target vehicle without sacrificing the vehicle's flight efficiency. It would further be advantageous to provide for a decoy device that is environmentally friendly.

BRIEF SUMMARY OF THE INVENTION

The invention addresses the above needs and achieves other advantages by providing a decoy device that is capable of being deployed from an aircraft to provide a defensive mechanism for a target vehicle. Furthermore, the decoy device utilizes a propellant that reacts with a catalyst to produce a sufficient amount of thrust to maintain the decoy device in an airborne position, while also luring the missile away from the target vehicle. The decoy device is capable of maintaining an airborne position between the target vehicle and a missile for a predetermined amount of time without emitting hazardous chemicals or byproducts.

In one embodiment of the present invention, a decoy device for anti-missile protection is provided. The decoy device includes a tank containing a propellant. The decoy device also includes an outlet defined by the tank, and a catalyst contained within the tank and capable of exothermically reacting with the propellant to produce a gas having a heat and pressure. The gas is expelled through the outlet to provide thrust to the decoy device and to attract a missile.

In various aspects of the present invention, the propellant is at least one of a gas and liquid. Further, the propellant may be environmentally friendly. The propellant may also be a monopropellant. The monopropellant may include a fuel, where the fuel includes at least one of hydrogen, methane, ethane, hydrazine, amines, hydrocarbons, and combinations thereof. The monopropellant may also include an inert gas, where the inert gas includes at least one of nitrogen, helium, argon, zenon, krypton, carbon dioxide, and combinations thereof. In addition, the monopropellant may further include an oxidizer, where the oxidizer includes at least one of oxygen, air, oxygen difluoride, and combinations thereof. The catalyst could include a catalytic bed, where the catalytic bed may include at least one of gold, silver, mercury, platinum, palladium, iridium, rhodium, ruthenium, osmium, and combinations thereof.

In further aspects of the decoy device, the tank may be formed of a composite material and/or a metallic material. The tank could comprise a heat sink capable of capturing and re-radiating the heat of the gas. The decoy device may also include a valve positioned between the propellant and the catalyst, where the valve has a closed position in which the propellant and the catalyst are separated and an open position in which the propellant is capable of mixing and reacting with the catalyst. The tank may be thrust by the exhaust such that the tank is capable of being deployed from a target airplane and maintained in an airborne position between the missile and the target airplane. Moreover, the gas may have a temperature substantially matching an acquisition wavelength of the missile such that the missile will disengage from the target and follow the decoy device.

The present invention may also be embodied in a system for anti-missile protection. The system includes a decoy device as described above and a target vehicle. The target vehicle, such as an aircraft or helicopter, carries the decoy device and is capable of deploying the decoy device from the target vehicle. The decoy device may further include a defensive mechanism, where the defensive mechanism includes at least one of a chaff, explosive, and decoy.

Another aspect of the present invention also provides a method for deploying a device for anti-missile protection. The method includes deploying a decoy device from a target vehicle. The method also includes reacting at least one of a gas and liquid propellant with a catalyst within the decoy device. Moreover, the method includes attracting a missile with heat generated by the reaction, and thrusting the tank with pressure generated by the reaction.

In additional aspects of the method, the method includes deploying a plurality of decoy devices sequentially such that each decoy device is deployed separately and attracts the missile for a predetermined amount of time. The method may also include opening a valve positioned between the propellant and the catalyst following the deploying of the device such that the gas produced and expelled as a product of the resulting reaction causes the decoy device to continue to move. Furthermore, the method may include deploying a defensive mechanism from the decoy device, such as a chaff, explosive, electronics, or decoy. Also, the method may include detecting the missile with a detection system and sending a warning signal prior to deploying the decoy device. In addition, the method may include reacting at least one of a liquid and gas propellant with the catalyst.

The present invention therefore provides a decoy device that is capable of protecting a target vehicle from surface-to-air and air-to-air missiles. The decoy device could be used with both military aircraft and civilian aircraft. The combination of a propellant and a catalyst provides an exothermic reaction that produces a sufficient amount of heat to lure the missile away from the exhaust of the target vehicle. The exothermic reaction also produces a sufficient amount of pressure to thrust and maintain the decoy device airborne for a predetermined period of time. By allowing the decoy device to "float" between the target vehicle and the missile, fewer decoy devices are required than typical flares. In addition, the exothermic reaction does not produce any toxic byproducts, and the decoy device burns out within a few seconds such that potential fires on the ground are reduced. Therefore, the target vehicle does not increase the risk of secondary issues on the ground, which is advantageous when the vehicle deploys the decoy device over civilian areas.

Moreover, the present invention can provide personnel low risk of handling materials during installation, inspection, servicing, and removal of the hardware. If low toxicity propellants are used that only react in the environment of a catalyst (e.g., Trydine or similar environmentally safe propellants), the reactants and products will be safe to handle. This reduces costs in training, procedures, and potential incidents requiring medical attention.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
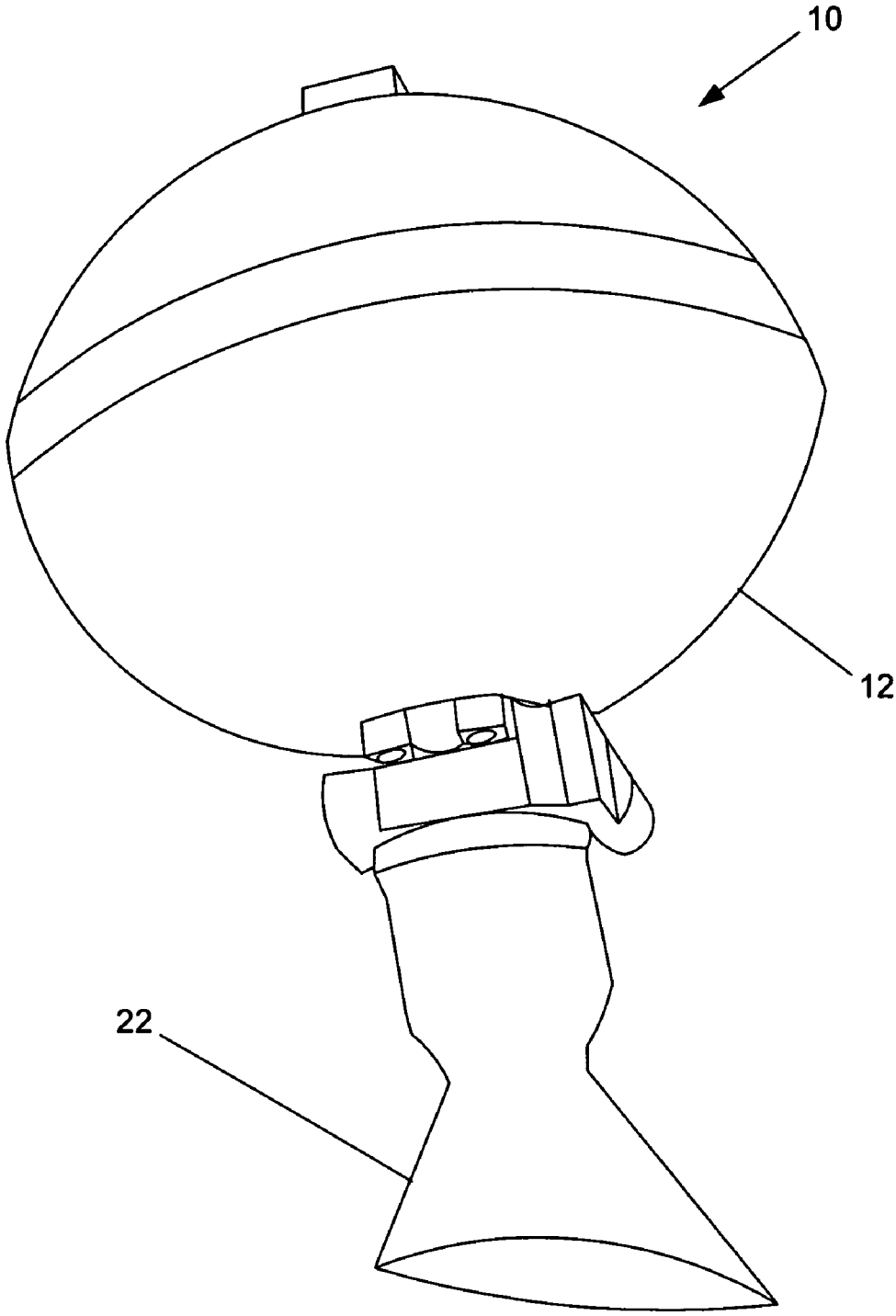
FIG. 1 is perspective view illustrating a decoy device, according to one embodiment of the present invention.

Referring now to the drawings and, in particular to FIG. 1 there is shown a decoy device 10. The decoy device 10 is capable of using a propellant to provide thrust to the decoy device, as well as serve as a decoy for infrared or heat-seeking missiles such that the missile is lured away from a target vehicle. The decoy device 10, as the term is used herein, is not meant to be limiting and may include any device capable of being deployed from a vehicle and providing anti-missile protection for the vehicle. Similarly, the term "target vehicle" is not meant to be limiting and may include any vehicle capable of carrying the decoy device. Thus, the target vehicle could be a helicopter, an aircraft, or other airborne vehicle that is susceptible to a surface-to-air or air-to-air missile attack. The target vehicle could be either commercial or military and utilize the decoy device 10, as will be discussed in further detail below.

Figure 2:
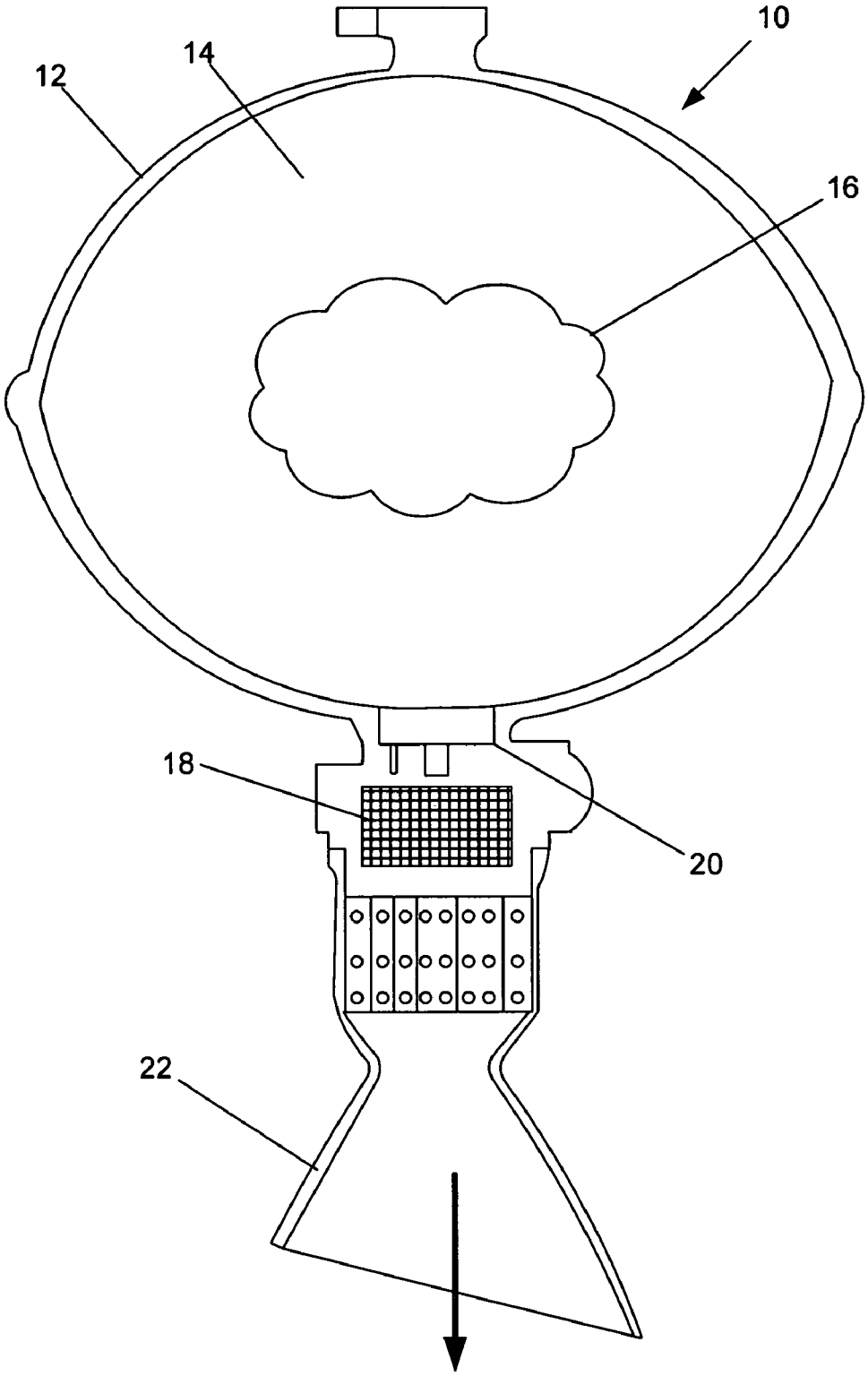
FIG. 2 is a cross-sectional view of the decoy device shown in FIG. 1, according to one embodiment of the present invention.

The decoy device 10 shown in FIG. 2 includes a tank 12 and a chamber 14 defined by the tank for housing a propellant 16 and a catalyst 18. The tank 12 may be divided by a partition to separate the propellant 16 from the catalyst 18, and a valve 20 may be positioned between the propellant 16 and the catalyst 18 such that the propellant is maintained separate from the catalyst while the valve 20 is in a closed position. When the valve 20 is opened, the propellant 16 travels through the valve and into contact with the catalyst 18. While a partition and a valve 20 are depicted to separate the propellant 16 and the catalyst 18, the tank 12 can include other devices or mechanisms for separating the catalyst if so desired. Once in contact, the propellant 16 and catalyst 18 create an exothermic reaction, which produces a gaseous exhaust having a heat and pressure. The pressure created by the reaction causes the exhaust to escape through a nozzle 22 defining an outlet in the tank 12 and provides thrust to the decoy device 10. The heat is radiated from the tank 12 to create an infrared heat source that acts to attract an infrared or heat-seeking missile.

The tank 12 could be any suitable reservoir that is capable of containing the propellant 16 within the tank. In the instance where the propellant 16 is a gas, the propellant is contained within the tank 12 such that the tank is pressurized with the propellant. Thus, when the valve 20 is opened, the propellant 16 is directed through the valve and towards the lower pressure area where the catalyst 18 is located. Similarly, when the propellant 16 is a liquid, the propellant could flow through the valve 20 and into contact with the catalyst 18 by either gravity, a pump, blow down, pressurized feedback, or any similar technique. The tank 12 is typically a thermal heat sink that is capable of absorbing and re-radiating the heat produced from the reaction of the propellant 16 and the catalyst 18. Thus, the tank 12 could be a metal tank such as, for example, a carbon steel, aluminum, or stainless steel tank, that may conduct and radiate heat, or in additional embodiments of the present invention, the tank could be a composite material, or a combination of composite and metal. For instance, a composite tank may include a metal liner. In one embodiment of the present invention, the tank 12 is capable of re-radiating the heat produced from the exothermic reaction within one second, although any desired time interval may be used in additional embodiments of the present invention. Although the tank 12 is shown in FIG. 1 as being spherical, it is understood that the tank could be any suitable shape and cross section to contain the propellant 16 and house the catalyst 18.

The propellant 16 may be a gas or liquid and may also be environmentally friendly and possess a low toxicity. The propellant 16 is typically a monopropellant such as Tridyne manufactured by Rocketdyne Propulsion & Power, as known to those skilled in the art. Tridyne includes various mixtures of fuel, oxidizer, and inert gas, which is described in U.S. Pat. No. 3,779,009 to Friedman and is incorporated herein by reference. The fuel may include, for example, hydrogen, methane, ethane, amine, hydrocarbon, and any mixture thereof, and any similar fuel, while the inert gas may include, for example, nitrogen, helium, argon, zenon, krypton, carbon dioxide, mixtures thereof, and any similar combustion or storage inert gas. In addition, the oxidizer may include, for example, oxygen, air, oxygen difluoride, mixtures thereof, and any similar oxidizer. As such, any combination of fuel, oxidizer, and inert gas may be used in alternative embodiments of the present invention. Examples of environmentally friendly propellants 16 include Tridyne or methane.

Because Tridyne is non-reactive under normal conditions, a catalyst 18 is required to react the Tridyne. The catalyst 18 generally includes a catalyst bed that is capable of causing an exothermic reaction with the propellant 16. The catalyst bed is typically a noble metal such as, for example, any one of gold, silver, mercury, platinum, palladium, iridium, rhodium, ruthenium, osmium, combinations thereof, or any similar catalyst or compound. In addition, the catalyst could be other materials and composites known to those skilled in the art in additional embodiments of the present invention. Various shapes and sizes of the catalyst bed may be employed in additional embodiments of the present invention, which is described in U.S. Pat. No. 3,779,009 to Friedman and is incorporated herein by reference.

The propellant 16 may also include hydrazine, as known to those skilled in the art. Hydrazine is a nitrogen/hydrogen compound and is typically used as a liquid rocket fuel. The catalyst 18 is typically heated, and when brought into contact with the hydrazine, the hydrazine is ignited. Although hydrazine is not as light as Tridyne, hydrazine produces a greater thrust to weight ratio than that of Tridyne. Furthermore, the propellant 16 could include a cold gas system, as known to those skilled in the art, such as Helium or Nitrogen, that is used in combination with heat to generate a warm gas propellant. As such, the exothermic reaction of a propellant 16, such as Tridyne or hydrazine, may be used to heat the cold gas to improve the cold gas thrust properties. Using hydrazine or a combination of a cold gas and a monopropellant typically results in a higher thrust to weight ratio, which may be desirable for defending against certain types of missiles.

Figure 3:
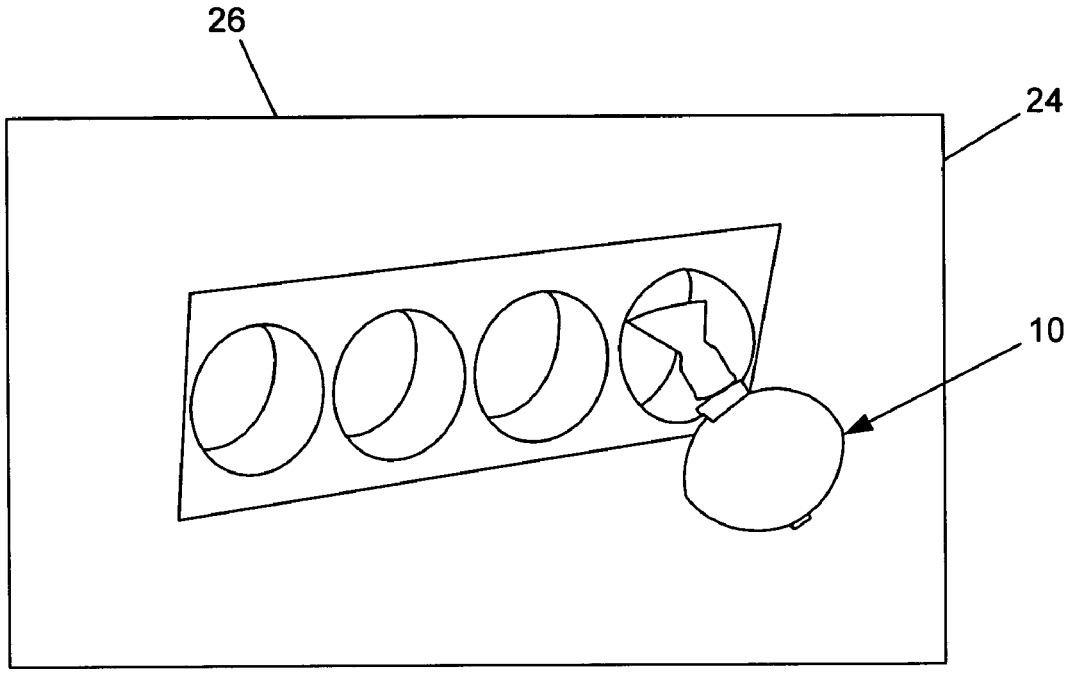
FIG. 3 is a plan view of a portion of a target vehicle employing the decoy device shown in FIG. 1, according to one embodiment of the present invention.

The decoy device 10 may be carried by a target vehicle 24, a portion of which is illustrated in FIG. 3. The target vehicle 24 defines a plurality of ports 26 that may be used in conjunction with a magazine internal to the target vehicle to deploy each of the decoy devices 10, as known to those skilled in the art. However, the target vehicle 24 may include other mechanisms for storing and launching the decoy devices 10. The target vehicle 24 may be equipped with any number of decoy devices 10 and respective ports 26, and is typically capable of deploying each of the decoy devices separately in predetermined time increments. As such, each decoy device 10 is deployed in a sequential manner in predetermined time increments. However, all or some of the decoy devices 10 may be deployed at any given time, if desired. Moreover, while the target vehicle 24 may include a separate port 26 for each decoy device 10, multiple decoy devices may instead be launched sequentially from the same port.

Figure 4:
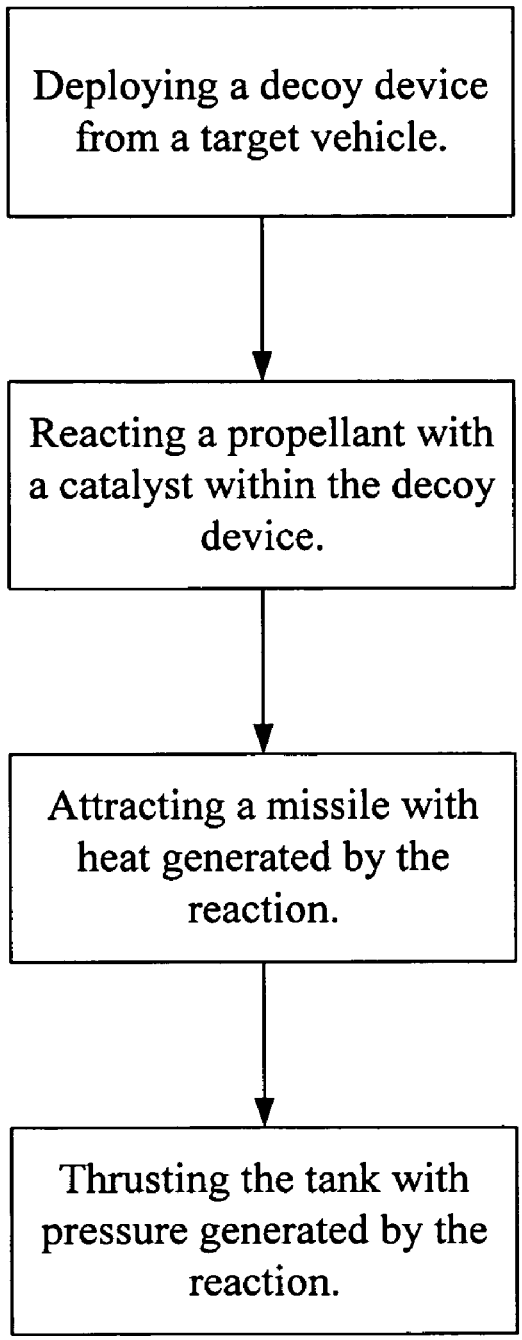
FIG. 4 is a flowchart illustrating a method of using the system shown in FIG. 3, according to one embodiment of the present invention.

As shown in the flowchart in FIG. 4, when the decoy device 10 is deployed from the target vehicle 24, the valve 20 is opened to allow the propellant 16 to travel through the valve and into contact with the catalyst 18. In one embodiment the propellants 16 are capable of moving to the catalyst 18 and to the nozzle 22 within a predetermined time, for example, within tenths of a second. Upon contacting the catalyst 18, the propellant 16 exothermically reacts with the catalyst to produce a gaseous exhaust. The gaseous exhaust produced from the reaction includes byproducts of heat and pressure. The pressure will cause the exhaust to expel through the nozzle 22 to thrust and maintain flight stability of the decoy device 10. The thrust created would typically propel the decoy device 10 in a direction substantially similar to that of the target vehicle 24 such that the decoy device may maintain a position between the target vehicle and missile for the longest time possible for a respective decoy device 10. The heat produced from the reaction is radiated outwardly from the decoy device 10, and is typically a temperature substantially similar to that of an acquisition wavelength of the missile. Moreover, the concentrations of the propellant 16 or catalyst 18 may be adjusted to produce various degrees of heat and pressure to accommodate a desired defensive strategy, such as for various target vehicle 24 and missile speeds. The heat is also able to transfer to any remaining propellant 16 within the tank 12 that did not contact the catalyst 18. Thus, a substantial amount of the contained propellant 16 is reacted so that there is reduced waste and increased utilization of the propellant.

Figure 5:
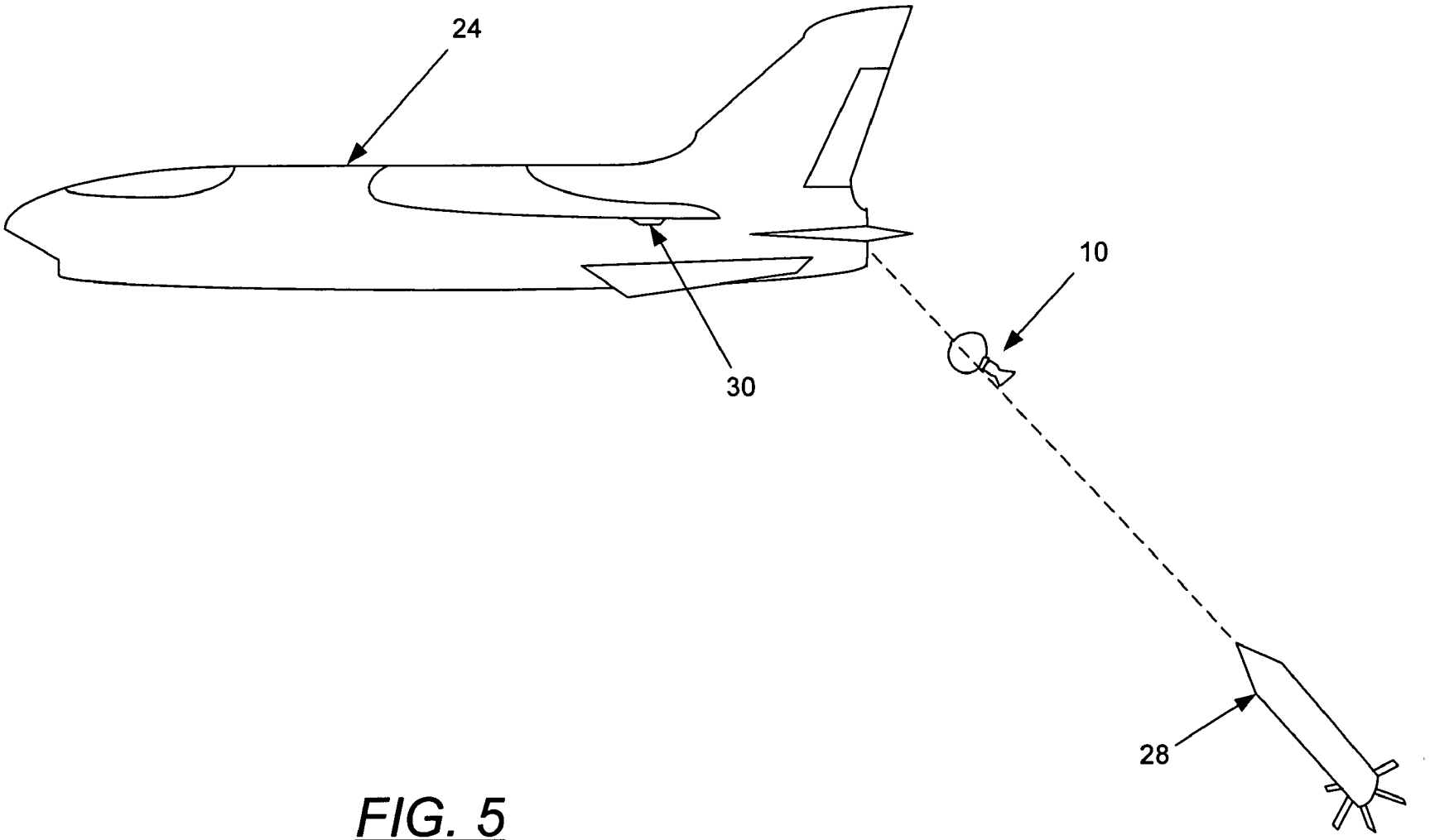
FIG. 5 is an elevation view illustrating the decoy device of FIG. 1 protecting a target vehicle, according to one embodiment of the present invention.

As shown in FIG. 5, the decoy device 10 is capable of maintaining a "floating" position between the target vehicle 24 and a missile 28, where the target vehicle is an aircraft in the illustrated embodiment of the present invention. In one embodiment, the decoy device 10 is preferably positioned between the missile 28 and the target vehicle's 24 highest heat source, which is typically the target vehicle's engine exhaust. The missile 28 is typically a surface-to-air or air-to-air missile, but could also be a shoulder-launched missile (e.g., Stinger). Because the decoy device 10 is able to maintain a position between the target vehicle 24 and missile 28, the decoy device is able to attract and lure the missile away from the target vehicle. In addition, the decoy device 10 is capable of maintaining its position between the target vehicle 24 and missile 28 for a longer period of time than typical flares so that fewer decoy devices, than flares, are required to be deployed from the target vehicle. In order to ensure that the missile is lured away from the target vehicle 24 in a continuous manner, a subsequent decoy device is advantageously deployed as a previously deployed decoy device 10 begins to descend or lose sufficient amount of heat to lure the missile away from the target vehicle. In this regard, several decoy devices 10 may be deployed at one time if desired, or in a sequential manner in predetermined time intervals.

The decoy device 10 may employ other features in additional embodiments of the present invention. For example, the target vehicle 24 may include a detection device 30 that is capable of detecting the missile 28 such as, for example, the AN/AAR-47, Missile Approach Warning System (MAWS) used on a C-17. According to one embodiment of the present invention, when the detection device 30 detects a missile that has locked onto the target vehicle 24, the detection device may issue a warning to the target vehicle 24 so that the target vehicle may activate the decoy device 10. As such, the detection device 30 typically eliminates the need to unnecessarily deploy several decoy devices, as the detection device is able to detect if a missile 28 has locked onto the target aircraft, thereby determining if an actual threat exists. Within one tenth of a second, the detection device 30 is capable of sending a signal to deploy the decoy device 10 and produce the exothermic reaction, although activation of the decoy device could be accomplished in any desired time interval in additional embodiments of the present invention. Thus, the total time to activate the decoy device 10, as well as render the decoy device capable of attracting a missile 28 is substantially short to readily defend the target vehicle 24 from an attacking missile. The detection device 30 may also be embodied in the decoy device 30 to track the missile 28, but would ultimately increase the size and weight of the decoy device.

The decoy device 10 could also include additional defensive mechanisms that may be used in conjunction with the decoy device. For example, the defensive mechanism could include a chaff, explosive, decoy, mechanical/electrical devices, or other mechanism known to those skilled in the art. The defensive mechanism would provide additional protection for the target vehicle 24 that may be deployed from the decoy device 10. For example, the defensive mechanism could be launched from the decoy device 10 following deployment of the decoy device as an additional protective measure, or the defensive mechanism could be separately launched from the target vehicle 24 from the decoy device.

The present invention therefore provides a decoy device 10 that is capable of protecting a target vehicle 24 from surface-to-air and air-to-air missiles. The decoy device 10 could be used with both military aircraft and civilian aircraft. The combination of a propellant 16 and a catalyst 18 provide an exothermic reaction that produces a sufficient amount of heat to attract and lure the missile away from the exhaust of the target vehicle 24. The exothermic reaction also produces a sufficient amount of pressure to provide thrust and maintain the decoy device 10 airborne for a predetermined period of time. By allowing the decoy device 10 to "float" between the target vehicle 24 and the missile 28, fewer decoy devices are required than typical flares. In addition, the exothermic reaction does not produce any toxic byproducts, and the decoy device 10 burns out within seconds such that potential fires on the ground are reduced. Therefore, the target vehicle 24 does not increase the risk of secondary issues on the ground, which is advantageous when the vehicle deploys the decoy device 10 over civilian areas.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A decoy device for anti-missile protection, comprising:
a propellant;
a catalyst;
a tank defining an outlet and configured to store the propellant and the catalyst in a non-reactive state; and
a mechanism configured to bring the propellant and the catalyst into contact with one another within the tank such that the catalyst is capable of exothermically reacting with the propellant to produce a gas having a heat and pressure, wherein the heat generated by the exothermic reaction is radiated by the decoy device to attract a missile, and wherein the gas is expelled through the outlet to provide thrust to the decoy device.

2. The decoy device according to claim 1, wherein the propellant comprises at least one of a gas and liquid propellant.

3. The decoy device according to claim 1, wherein the propellant is a monopropellant.

4. The decoy device according to claim 3, wherein the monopropellant comprises a fuel, the fuel comprising at least one of hydrogen, methane, ethane, hydrazine, amines, hydrocarbons, and combinations thereof.

5. The decoy device according to claim 4, wherein the monopropellant further comprises an inert gas, the inert gas comprising at least one of nitrogen, helium, argon, zenon, krypton, carbon dioxide, and combinations thereof.

6. The decoy device according to claim 5, wherein the monopropellant further comprises an oxidizer, the oxidizer comprising at least one of oxygen, air, oxygen difluoride, and combinations thereof.

7. The decoy device according to claim 1, wherein the catalyst comprises a catalytic bed.

8. The decoy device according to claim 7, wherein the catalytic bed comprises at least one of gold, silver, mercury, platinum, palladium, iridium, rhodium, ruthenium, osmium, and combinations thereof.

9. The decoy device according to claim 1, wherein the tank is formed of at least one of a composite material and a metallic material.

10. The decoy device according to claim 1, wherein the tank comprises a heat sink capable of capturing and re-radiating the heat of the gas.

11. The decoy device according to claim 1, wherein the mechanism comprises a valve positioned between the propellant and the catalyst, the valve having a closed position in which the propellant and the catalyst are separated and an open position in which the propellant is capable of mixing and reacting with the catalyst.

12. The decoy device according to claim 1, wherein the tank is thrust by the exhaust such that the tank is capable of being deployed from a target airplane and maintained in an airborne position between the missile and the target airplane.

13. The decoy device according to claim 1, wherein the gas has a temperature substantially matching an acquisition wavelength of the missile.

14. The decoy device according to claim 1, wherein the propellant is environmentally friendly.

15. A system for anti-missile protection, comprising:

a decoy device comprising:

a liquid or gaseous propellant;

a tank containing the propellant and defining an outlet; and a catalyst contained within the tank and capable of exothermically reacting with the propellant to produce a gas having a heat and pressure, wherein the heat generated by the exothermic reaction is radiated by the decoy device to attract a missile, and wherein the gas is expelled through the outlet to provide thrust to the decoy device; and a target vehicle carrying the decoy device, the target vehicle capable of deploying the decoy device from the target vehicle.

16. The system according to claim 15, wherein the propellant is a monopropellant.

17. The system according to claim 16, wherein the monopropellant comprises a fuel, the fuel comprising at least one of hydrogen, methane, ethane, hydrazine, amines, hydrocarbons, and combinations thereof.

18. The system according to claim 17, wherein the monopropellant further comprises an inert gas, the inert gas comprising at least one of nitrogen, helium, argon, zenon, krypton, carbon dioxide, and combinations thereof.

19. The system according to claim 18, wherein the monopropellant further comprises an oxidizer, the oxidizer comprising at least one of oxygen, air, oxygen difluoride, and combinations thereof.

20. The system according to claim 15, wherein the catalyst comprises a catalytic bed.

21. The system according to claim 20, wherein the catalytic bed comprises at least one of gold, silver, mercury, platinum, palladium, iridium, rhodium, ruthenium, osmium, and combinations thereof.

22. The system according to claim 15, wherein the tank is formed of at least one of a composite material and a metallic material.

23. The system according to claim 15, wherein the tank comprises a heat sink capable of capturing and re-radiating the heat of the gas.

24. The system according to claim 15, further comprising a valve positioned between the propellant and the catalyst, the valve having a closed position in which the propellant and the catalyst are separated and an open position in which the propellant is capable of mixing and reacting with the catalyst.

25. The system according to claim 15, wherein the tank is thrust by the exhaust such that the tank is capable of being deployed from the target vehicle and maintained in an airborne position between the missile and the target vehicle.

26. The system according to claim 15, wherein the gas has a temperature substantially matching an acquisition wavelength of the missile.

27. The system according to claim 15, wherein the target vehicle comprises one of an aircraft and helicopter.

28. The system according to claim 15, wherein the target vehicle further comprises a detection device capable of detecting the missile.

29. The system according to claim 15, wherein the decoy device further comprises a defensive mechanism, the defensive mechanism comprising at least one of a chaff, explosive, and decoy.

30. The system according to claim 15, wherein the propellant is environmentally friendly.

31. A method for deploying a device for anti-missile protection, comprising:

deploying a decoy device from a target vehicle;

exothermically reacting a liquid or gaseous propellant with a catalyst within the decoy device;

radiating heat generated by the exothermic reaction from the decoy device so as to attract a missile; and thrusting the decoy device with pressure generated by the exothermic reaction.

32. The method according to claim 31, further comprising deploying a plurality of decoy devices sequentially such that each decoy device is deployed separately and attracts the missile for a predetermined amount of time.

33. The method according to claim 31, further comprising opening a valve positioned between the propellant and the catalyst following the deploying of the device.

34. The method according to claim 31, further comprising deploying a defensive mechanism from the decoy device, the defensive mechanism comprising at least one of a chaff, explosive, electronics, and decoy.

35. The method according to claim 31, further comprising detecting the missile with a detection system prior to deploying the decoy device.

36. The method according to claim 35, further comprising sending a warning signal prior to deploying the decoy device.

* * * * *